US008459514B2

(12) United States Patent
Lagzdins

(10) Patent No.: US 8,459,514 B2
(45) Date of Patent: Jun. 11, 2013

(54) COLLAPSIBLE ADJUSTABLE GARMENT HANGING DEVICE

(76) Inventor: Bruce Lagzdins, Prince George (CA)

( * ) Notice: Subject to any disclaimer, the term of this patent is extended or adjusted under 35 U.S.C. 154(b) by 160 days.

(21) Appl. No.: 13/078,035

(22) Filed: Apr. 1, 2011

(65) Prior Publication Data

US 2011/0259927 A1 Oct. 27, 2011

Related U.S. Application Data

(60) Provisional application No. 61/327,752, filed on Apr. 26, 2010.

(51) Int. Cl.
*A41D 27/22* (2006.01)
*A47G 25/40* (2006.01)

(52) U.S. Cl.
USPC ..... 223/89

(58) Field of Classification Search
USPC ..... 223/85, 98
See application file for complete search history.

(56) References Cited

U.S. PATENT DOCUMENTS 1,111,147 A * 9/1914 Fogde ..... 223/89
D157,089 S * 1/1950 Saunders ..... D6/318
2,611,517 A * 9/1952 Simonsen ..... 223/88
2,810,500 A * 10/1957 Wingate ..... 223/89
3,254,814 A * 6/1966 Weir et al. ..... 223/89
5,044,535 A 9/1991 Hunt
5,085,357 A * 2/1992 Chen ..... 223/89
5,145,098 A 9/1992 Tung
5,397,038 A 3/1995 Hunt
5,456,391 A 10/1995 Chang
5,511,701 A 4/1996 Lam
5,664,710 A 9/1997 Lam
6,644,520 B2 11/2003 Lam
7,600,636 B2 * 10/2009 Bell ..... 206/286
7,641,084 B1 1/2010 Alcaraz
8,286,842 B2 * 10/2012 Carey ..... 223/89
2004/0016779 A1 1/2004 Salem
2004/0129744 A1 7/2004 Choi
2005/0035159 A1 2/2005 Hunt
2008/0257920 A1 10/2008 Spencer
2009/0277933 A1 11/2009 Goldman
2010/0038388 A1 * 2/2010 Munro ..... 223/85

* cited by examiner

*Primary Examiner* — Ismael Izaguirre
(74) *Attorney, Agent, or Firm* — Dainel Boudwin

(57) ABSTRACT

An adjustable, collapsible garment hanging device, consisting of a body, a crossbar and two hanging arms. The arms may be telescopically extended to allow for hanging larger or multiple garments. The crossbar has a plurality of hooks for additional garment hanging. Further, the center body of the hanging device is equipped with a cedar ball for garment freshness and an upper and lower hook for hanging the assembly.

7 Claims, 4 Drawing Sheets

COLLAPSIBLE ADJUSTABLE GARMENT HANGING DEVICE

CROSS REFERENCE TO RELATED APPLICATION

This application claims the benefit of U.S. Provisional Application No. 61/327,752 filed on Apr. 26, 2010, entitled "Dead Center Ultimate Hanger."

FIELD OF THE INVENTION

The present invention relates generally to adjustable and expandable clothes hangers for hanging various sizes, articles and numbers of clothing.

BACKGROUND OF THE INVENTION

Clothes hangers, also called garment hangers, coat hangers, or just hangers, have long been known in the art. Hangers can be constructed from metal wire, wood, plastic or a combination of materials. Commercially available hangers are generally a fixed length and cannot be adjusted for garments of different sizes.

Many types of clothing, such as sweaters, jackets, dresses, and shirts do not fit properly on standard hangers. A hanger of incorrect length terminates either on the shoulder or on the sleeve, leaving unsightly wrinkles or stretch marks. Traditional hangers generally bear one universal design, and are not constructed to accommodate various types of clothing. The smoothness of standard hangers can make them slippery, allowing many clothing articles to slide off and fall to the ground. This causes clothes to become wrinkled or dirty, requiring users to wash them again before use. Larger clothing items can develop undesirable indentations in the shoulders, which are caused by short hanger arms that do not extend across the full lengths of garments. Additionally, the ability to hang a variety of types of clothing such as undergarments is lacking in current hanger designs.

The present invention provides an effective and space efficient solution to the problem of ill-fitting hangers, allowing for multiple and unusual clothing items to be successfully stored without damage or unsightly wrinkles.

Patents have been granted, as well as applications published, to several designs which attempt to address the problem of fixed hanger lengths. The majority of these designs offer limited extension of the arms of the hanger or fail to successfully account for clothing of unusual shapes and sizes. Further the prior art does not demonstrate hangers which may handle multiple items of clothing.

Salem U.S. Pat. Pub. No. 2004/0016779 is directed toward an adjustable garment hanger comprising a hanger body having legs extending in a hanger widthwise direction. First and second leg extensions are each adjustably engaged to a leg of the hanger body to determine an overall width along the widthwise direction of the garment hanger. A collar support extends upwardly from the hanger body. A spacer functions to space the hanger centerline from centerlines of adjacent hangers hung on a common rod to prevent excessive contact on a garment hung on the hanger by adjacent hung garments.

Spencer U.S. Pat. Pub. No. 2008/0257920 is directed toward a garment hanger and a garment hanger apparatus. In particular, it relates to a garment hanger apparatus of the type in which the hanger arms for supporting a garment item are adjustable in length. In one embodiment an extension arm can be added to an existing hanger support arms and is infinitely adjustable in length by sliding along the support arm. Therefore, the effective length of the hanger arm can be selected and varied as desired.

U.S. Pat. Pub. No. 2004/0129744 is directed toward a folding and expanding hanger for narrow neck top wears is comprised of, including but not limited to, a spring, two solid wings, a pivot pin, a hook, and a member connecting the hook and pivot pin. The novel structure of the hanger of this invention enables a user for easy putting of a hanger inside of the narrow neck of, including but not limited to, a round T-neck shirt, a men's dress shirts after engaging the buttons, or a blouse. This is by means of folding the wings inward and pushing the hanger into the neck of the torso covering garment. The hanger holds the shape of the top portion of the garment having a narrow neck by simply releasing the wings.

U.S. Pat. No. 5,145,098 is directed toward a hanger for hanging jacket, suit or dress, which includes a central hook holder having a hook pivotally secured in the holder, a pair of upper holding members pivotally secured to the central hook holder by a pair of first vertical-axis hinges, a pair of shoulder members respectively pivotally secured to the two upper holding members by a pair of horizontal-axis hinges each. The shoulder member is telescopically mounted with a slide member slidably held on each shoulder member for adjustably hanging dress or the like, and a second vertical-axis hinge pivotally connecting the two shoulder members. The two upper holding members can be first folded downwardly about the horizontal-axis hinges to be superimposed on the shoulder members which are then folded rearwardly about the two vertical-axis hinges to greatly minimize a total volume of the folded hanger for a convenient handling and portable use.

U.S. Pat. No. 7,641,084 is directed toward an adjustable clothes hanger that includes a hollow body provided with a chamber formed therein, first and second arms conjoined to the body and disposed exterior of the chamber, and a mechanism for slidably and linearly displacing the first and second arms along respective linear paths in such a manner that the first and second arms simultaneously extend and retract along opposed flanges of the body. The device further includes first and second hooks partially seated within the chamber and disposed along the flanges. Each of such first and second hooks has top ends terminating outwardly from the chamber and traversing respective travel paths of the first and second arms when the primary and secondary dials are rotated in corresponding directions such that the first and second arms are engaged and stopped from traveling therebeyond.

U.S. Pat. Pub. No. 2005/0035159 is directed toward a garment hanger has a body with a longitudinal axis. A movable first arm is slidably mounted on the body for free movement with respect to the body substantially along the longitudinal axis. A constant or decreasing force spring applies a resilient force to the first arm to urge the first arm outwards of the body so that the first arm is able to move between a retracted position and an extended position relative to the body. The resilient force exerted by the garment hanger remains substantially constant or increases between a fully retracted position and a fully extended position.

U.S. Pat. No. 6,644,520 is directed toward an adjustable garment hanger is disclosed having movable arms which move laterally from a medial portion. The arms move because of engagement between a pair of linkage tongues and a medially positioned adjustment mechanism. The linkage tongues are positioned inside a U-shaped guiding channel positioned parallel to a pair of supporting arms extending from the medial portion of the garment hanger.

U.S. Pat. No. 5,664,710 is directed toward an adjustable garment hanger is disclosed having extension members which move laterally from a medial portion. The extension members move as a result of engagement between a pair of tongues and medially disposed pinions. Disclosed embodiments include manual adjustment knobs and bidirectional electric motors coupled to the pinion. Embodiments also include apparatus for indicating hanger size obtained by movement of the extension members.

U.S. Pat. No. 5,511,701 is directed toward an adjustable garment hanger is disclosed having extension members which move laterally on a hanger frame. The extension members move as a result of engagement between a pair of flexible racks and a medially disposed pinion. Disclosed embodiments include manual adjustment knobs and bidirectional electric motors coupled to the pinion. Embodiments also include apparatus for indicating hanger size obtained by movement of the extension members.

U.S. Pat. No. 5,456,391 is directed toward a suit hanger with adjustable shoulder members includes a main frame, an actuating assembly and a slidable shoulder members. By the action of the actuating assembly, the slidable shoulder can be extended to a full length to increase the width of the suit hanger or be fully retracted to decrease the width of the suit hanger. In light of this, the suit hanger can be readily adjusted to meet different requirements.

U.S. Pat. No. 5,397,038 is directed toward an expandable garment hanger with which the invention is concerned has a body, a hook on the body to suspend the hanger and a pair of movable arms, slidably mounted on the body. The arms are arranged to move in opposite directions. A locking device is located on the body of the hanger so as to lock the movable arms relative to the body. The locking device is movable along a path parallel to the path along which the arms are movable. A biasing device, preferably a spring is provided for biasing the locking device against movement in one direction so that when the arm of the hanger is set and locked in position the arms of the hanger are movable against the biasing force of the spring. The hanger conveniently supports garments of varying waist widths and maintains the hanger at the desired widths once the garment is mounted on the hanger but also allows the garment to be removed from the hanger by a small inward force applied to the end of the arm.

U.S. Pat. No. 5,044,535 is directed toward the garment hanger is disclosed having a body and a hook mounted on the body to suspend the hanger on a rail. A movable arm is conveniently slidably mounted in the body for free movement in at least one direction, preferably the outward direction. A locking device is mounted on the body to lock the movable arm relative to the body against movement in an inwardly direction preferably by the interengagement of teeth on the locking device with ratchet teeth along the top edge of the corresponding movable arm. The locking means is releasable by a lever mechanism operated remotely from the locking device to allow free movement of the arm in either an outward or inward direction. Conveniently, the releasable lever mechanism is mounted on a garment engagable portion at the outermost end of the movable arm. In one preferred embodiment of a garment hanger two arms are slidably simultaneously in the hanger body in mutually opposite directions, and the locking means is mounted for engagement with one of the movable arms.

Goldman U.S. Pat. Pub. No. 2009/0277933 is directed toward a clothes hanger extender which attaches to standard plastic clothes hanger so as to be able to adjust for different sized garments. The channel end has a hollow interior with a substantially elliptical cross section. The first portion of the channel, the channel locking portion, has a locking portion width which is smaller than the channel end's interior diameter. The second portion of the channel, the channel transition portion, connects the channel locking portion with the channel adjustment portion to make a continuous channel. The last portion of the channel is the channel adjustment portion. The channel adjustment portion allows the clothes hanger extender to slide over a standard plastic clothes hanger. The channel adjustment portion alternatively terminates at the shoulder end, or is the shoulder end, depending upon whether the shoulder end is a separate component. The entire channel is formed by a material which is sufficiently elastic to allow the channel to be expanded from the locking portion width to the interior diameter without permanently deforming the material.

These prior art devices fall into several different categories, each having its own set of drawbacks. The first series of patents claim hangers with extendable or unfoldable arms. Such hangers do allow for hanging objects that would otherwise be too large for a traditional hanger, but fail to fulfill a need to hang multiple or unusual garments. Additionally, such devices do not provide the flexibility of being collapsible, making them inconvenient for travel usage.

A second category of prior art devices are based around additionally attachments to hangers. These devices address the issue of portability to a degree, but fail to provide a full range of usuage on their own. Such devices require the presence of an additional standard hanger. The present invention addresses this issue by acting as a standalone device.

A third category of prior art devices are hangers which fold to be collapsible. These devices are hangers which simply fold or telescope to a smaller scale to allow easy packing and transport. While these hangers address the issue of collapsibility, they fail to account for the necessity of hanging multiple or unusual clothing items. Additionally, they have all the inherent flaws of a standard hanger in that clothing may become stretched or wrinkled when hung.

None of the prior art devices address the need for a collapsible, versatile hanger capable of suspending numerous and/or unusual clothing items. The present invention fulfills such a need.

SUMMARY OF THE INVENTION

In view of the foregoing disadvantages inherent in the known types of garment hangers now present in the prior art, the present invention provides a new expandable and adaptable hanger wherein the same can be utilized for providing convenience for the user when traveling or storing unusual sizes or numbers of clothing items.

The present invention holds various types and numbers of clothing items, of any size, in a wrinkle-free manner. The present invention comprises sturdy, telescopic arms with non-slip grips, made to hold clothing items that traditional hangers are unable to adequately support. The use of extendable arms, hooks, and clips allow the present invention to accommodate multiple clothing articles at once, preserving entire outfits prior to use. The present invention provides convenience when preparing for events that require formal or dressy attire, or while staying in hotel rooms with limited closet space.

Further, the present invention accommodates multiple garments of varying sizes and styles. The invention may be constructed in the style of a standard hanger, with a hanger body acting as the base. The arms of the device will extend from the hanger body and may be telescopic, extending the length of each hanger arm. The hanger arms may be covered with a non-slip, rubber material, preventing clothes from sliding off and falling to the ground. The present invention may further include an upper hook attached to the hanger body to allow the device to hang from various surfaces. Additionally, a lower hook may be attached to the hanger body to hold extra clothing items or other hangers. At the base of the upper hook of the present invention, there may be present a utility bar element, designed to help support the hanger arms in a straight position. Additional clothing items may be hung from the utility bar element. Further, clips may be provided on the utility bar and on the ends of the arms for added security. A small ball made of cedar may be included above the lower hook to absorb odors and repel moths and insects. The arms and clips may be made of plastic, while the hooks may be made of metal material. When not in use, the present invention is folded into a compact form, allowing it to be easily stored or transported. Further, the present invention may be made available in a variety of colors to suit user preferences.

It is therefore an object of the present invention to provide the practitioner with a device allowing for convenient hanging of numerous sizes of garments, in a collapsible and portable manner. It is a further object of this device to allow the hanging of any type of garment without risk of damage or unsightly wrinkles. Another object of the present invention is to provide the ability to hang multiple articles of clothing on a single hanger.

Other objects, features and advantages of the present invention will become apparent from the following detailed description taken in conjunction with the accompanying drawings.

BRIEF DESCRIPTIONS OF THE DRAWINGS

DETAILED DESCRIPTION OF THE INVENTION

The present invention holds various types and numbers of clothing items, of any size, in a wrinkle-free manner. The present invention comprises sturdy, telescopic arms with non-slip grips, made to hold clothing items that traditional hangers are unable to adequately support. The use of extendable arms, hooks, and clips allow the device to accommodate multiple clothing articles at once, preserving entire outfits prior to use.

The present invention accommodates multiple garments of varying sizes and styles. The invention may be constructed in the style of a standard hanger, with a hanger body acting as the base. The arms of the device extend from the hanger body and telescopic outward, extending the length of each hanger arm. The hanger arms may be covered with a non-slip material, such as rubber, to prevent clothes from sliding off and falling to the ground. The present invention may further include an upper hook attached to the hanger body to allow the device to hang from various surfaces. Additionally, a lower hook may be attached to the hanger body to hold extra clothing items or other hangers. At the base of the upper hook of the present invention, there may be present a utility bar element, designed to help support the hanger arms in a straight position. Additional clothing items may be hung from the utility bar element. Further, clips may be provided on the utility bar and on the ends of the arms for added security. Further, the present invention may include small ball made of cedar above the lower hook, to absorb odors and repel moths and insects. The hanger components may be made of plastic, metal or other suitable material. When not in use, the present invention may be folded into a compact form, allowing it to be easily stored or transported. Further, the present invention may be made available in a variety of colors to suit user preferences. The hanger is collapsible, to allow for simplified transport and traveling.

Figure 1:
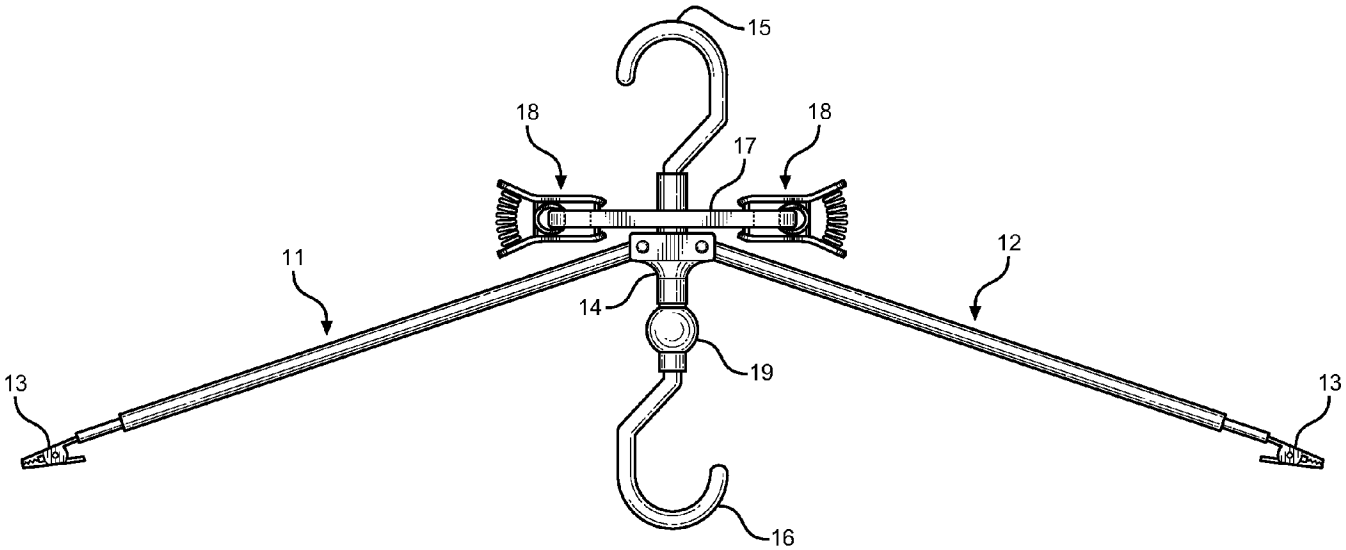
FIG. 1 is a frontal view of the present invention in the unfolded hanger position; additionally, clips are attached to the utility bar.

Referring now to FIG. 1, there is shown a frontal view of the present invention in the unfolded hanger position. The present invention comprises a hanger body 14, having laterally extendable telescoping legs 11, 12. The legs extend at an angle to the horizontal, in a positive and negative sense, allowing the legs to fold upward 90 degrees or downward 90 degrees. The legs 11, 12 attach to clips at the distal points 13. The hanger body 14 is attached to a top hook 15 and a bottom hook 16. Additionally, attached to the hanger body 14 is a horizontal utility bar 17 with a plurality of hanger attachment holes. Attached to the utility bar are a plurality of clips 18 for clothing attachment. Attached to the hanger body 14 and superior to the bottom hook 15 is a cedar ball 19.

Figure 2:
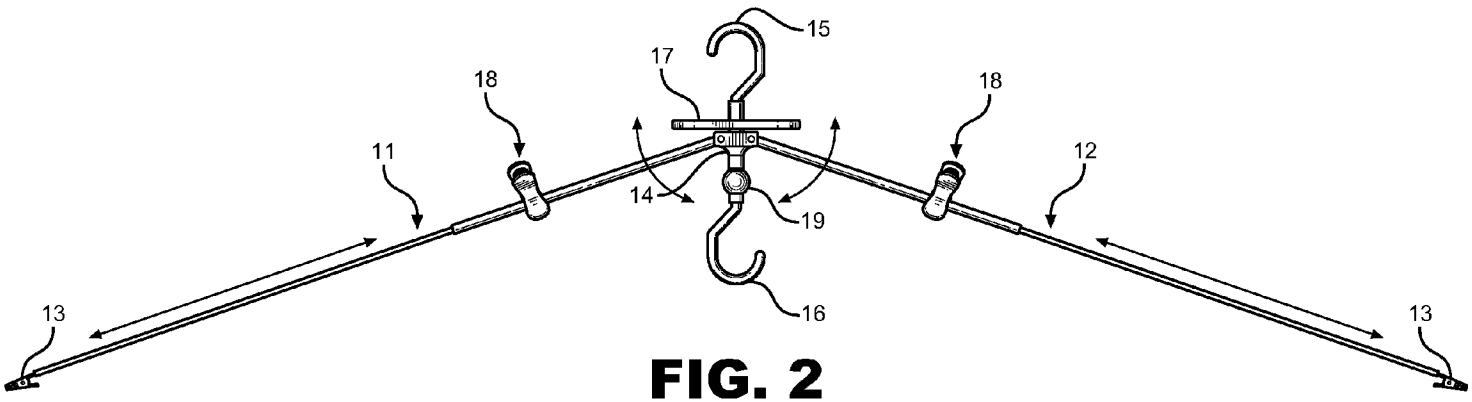
FIG. 2 is a frontal view of the present invention in the extended hanger position.

Referring now to FIG. 2, there is shown a frontal view of the present invention in the extended hanger position. The present invention comprises a hanger body 14, having laterally extendable telescoping legs 11, 12. The legs extend at an angle from the horizontal, and are attached to clips at the distal points 13. The hanger body 14 is attached to a top hook 15 and a bottom hook 16. Additionally, above the hanger body 14 and attached to the hanger body 14 is a horizontal utility bar 17 with a plurality of hanger attachment holes. A plurality of clips 18 are provided for attaching additional clothing from the device along the legs 11, 12 or the horizontal utility bar 17. Attached to the hanger body 14 and superior to the bottom hook 15 is a cedar ball 19.

Figure 3:
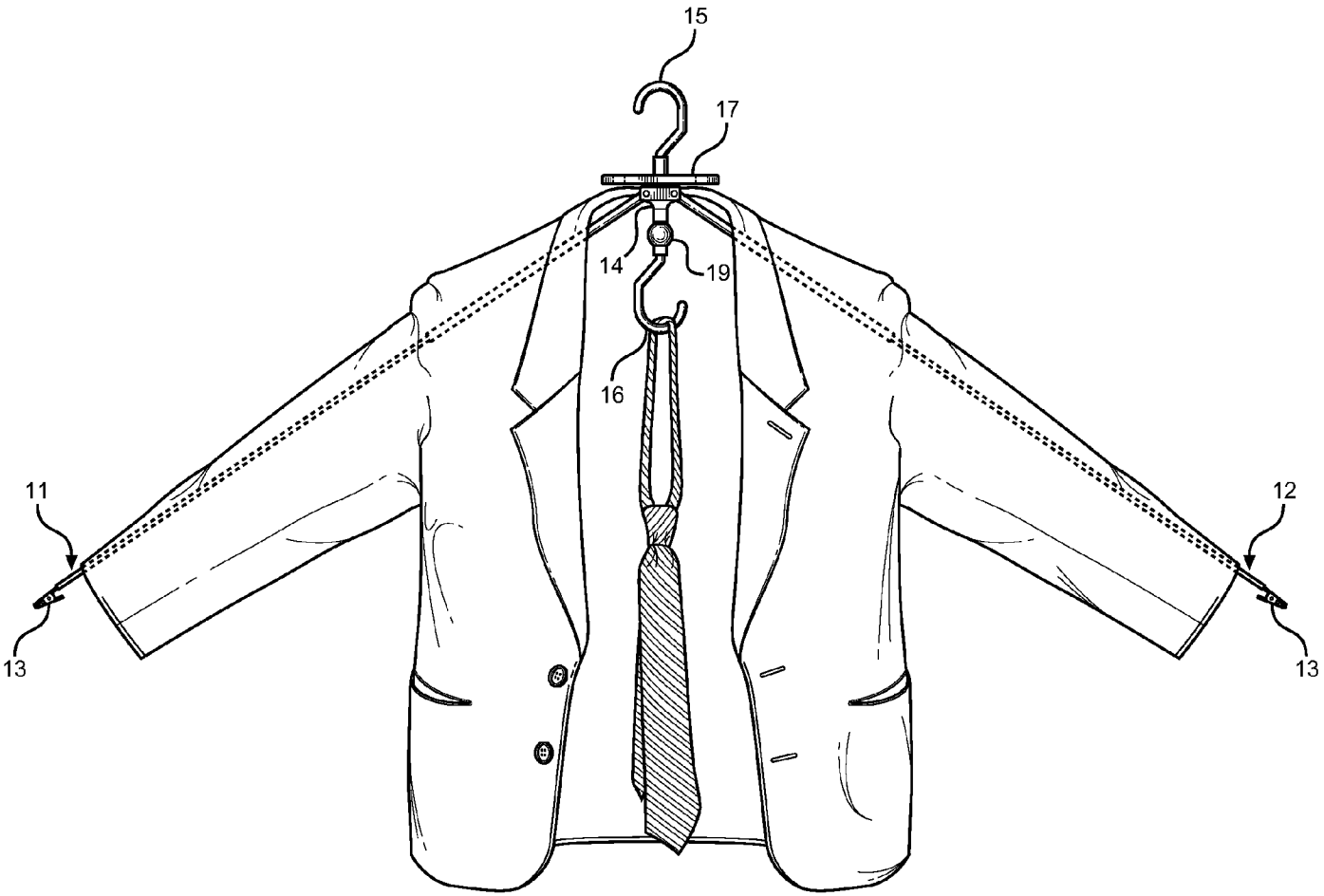
FIG. 3 is a frontal view depicting a man's suit coat and tie hung from the present invention.

Referring now to FIG. 3 there is shown a frontal view depicting a man's suit coat and tie hung from the present invention. The present invention comprises a hanger body 14, having laterally extendable telescoping legs 11, 12. The legs extend at an angle from the horizontal, and are attached to clips at the distal points 13. The hanger body 14 is attached to a top hook 15 and a bottom hook 16. Additionally, above the hanger body 14 and attached to the hanger body 14 is a horizontal utility bar 17 with a plurality of hanger attachment holes. Attached to the hanger body 14 and superior to the bottom hook 15 is a cedar ball 19. In this configuration, the hanger provides a means for supporting a shirt or sleeved garment without creating hard points around the shoulder region, which can locally deform the garment and create local protrusions that are difficult to remove.

Figure 4:
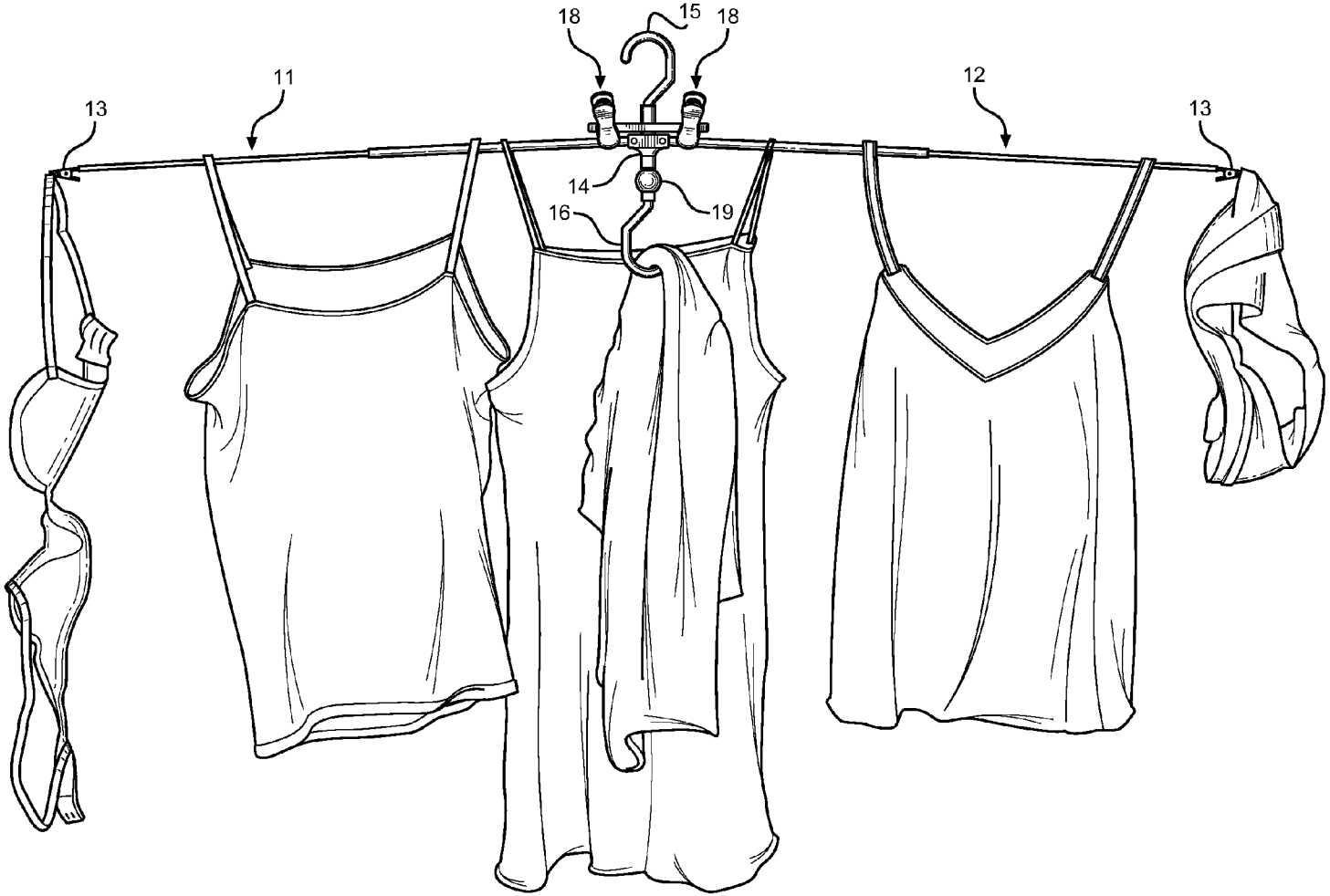
FIG. 4 is a frontal view depicting a variety of undergarments hung from various locations on the present invention in the extended hanger position.

Referring now to FIG. 4 there is shown a frontal view depicting a variety of undergarments hung from various locations on the present invention in the extended hanger position. The present invention comprises a hanger body 14, having laterally extendable telescoping legs 11, 12. The legs extend at an angle to the horizontal, and are attached to clips at the distal points 13. The hanger body 14 is attached to a top hook 15 and a bottom hook 16. Additionally, above the hanger body 14, and attached to the hanger body 14 is a horizontal utility bar 17. Attached to the device is a plurality of clips 18 for additional clothing attachment. Attached to the hanger body 14 and superior to the bottom hook 15 is a cedar ball 19.

Figure 5:
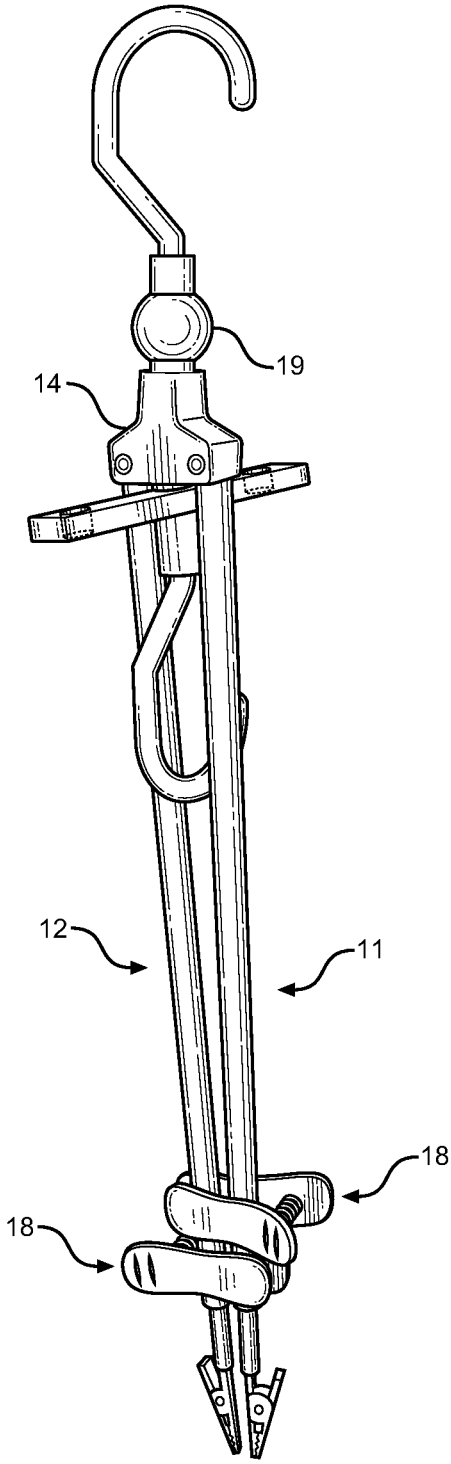
FIG. 5 is a frontal view depicting a collapsed view of the hanger assembly.

Referring now to FIG. 5, there is shown a view of the disclosed invention in a collapsed state, which allows the device to be easily stored and transported. The legs 11, 12 of the device are collapsed together along a vertical axis, aligned with the hanger body 14. The cedar ball 19 is superior to the hanger body 14 to allow complete collapsing of the two legs 11, 12, which are then clipped together using the attached clips 18. In this form, the device may be easily stored, placed inside of a travel bag or carried with one hand, improving the overall utility of the device. It may be common to pack the device in a suitcase for extended trips, where local accommodations do not provide adequate hanger support for a particular garment or a plurality of the user's clothing.

In one embodiment of the present invention, the device may be used as a standard coat hanger. The arms of the hanger, having clips at the distal ends, may be extended, allowing the practitioner to hang long sleeved items while maintaining wrinkle free clothing. Another aspect of the invention is the rotational nature of the arms of the hanger, in which the angle of the arms relative to the hanger body. Such rotation allows the arms to be collapsed downward to parallel with the hanger body for transport, or to any other angle with respect to the horizontal necessary to hang clothing items. Extending the arms horizontally can allow for multiple different garments to be hung, with or without the use of the included clips. A further aspect of the present invention allows clothing such as lighter undergarments and those difficult to hang with traditional hangers to be hung from the clips on the distal points of the hanger arms.

A horizontal utility bar is attached perpendicularly to the hanger body. The utility bar may be used for clip attachment and storage or as a bar from which to hang other hanger items. Along the utility bar is a plurality of hanger attachment holes, from which a series of secondary garment hangers may be hung, expanding the capability of the disclosed invention to include additional hanger accommodations. A second inverted hanger is also attached at the base of the hanger body. This lower hanger may be used to suspend other hanger devices for additional clothing storage, or used for smaller items such as ties, purses or bags. A further aspect of the invention is the inclusion of a cedar ball attached to the hanger body for maintaining clothing freshness over extended periods.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for hanging garments, comprising:
a central hanger body attached to two telescoping legs;
said legs are rotatable from said central hanger body along a vertical plane;
an upper and lower hook attached to a first and second end of said central hanger body;
and a horizontal utility bar attached to said central hanger body and extending perpendicularly therefrom;
said legs have an adjustable angle from said central hanger body ranging from horizontal to vertical in a single plane.

2. A device, as in claim 1, wherein a cedar ball is attached to said central hanger body.

3. A device, as in claim 1, wherein said legs terminate with a clip capable of grasping an article.

4. A device, as in claim 1, further comprising a plurality of removable clips capable of attaching to said legs and said central hanger body at various positions.

5. A device, as in claim 4, further comprising a plurality of locations on said utility bar to which said clips may be attached for storage.

6. A device for hanging garments, comprising:
a central hanger body attached to two telescoping legs;
said legs are rotatable from said central hanger body along a vertical plane;
an upper and lower hook attached to a first and second end of said central hanger body;
and a horizontal utility bar attached to said central hanger body and extending perpendicularly therefrom;
a plurality of removable clips capable of attaching to said legs and said central hanger body at various positions;
a plurality of locations on said utility bar to which said clips may be attached for storage.

7. A device for hanging garments, comprising:
a central hanger body attached to two telescoping legs;
said legs are rotatable from said central hanger body along a vertical plane;
an upper and lower hook attached to a first and second end of said central hanger body;
and a horizontal utility bar attached to said central hanger body and extending perpendicularly therefrom;
said legs terminate with a clip capable of grasping an article.

* * * * *